US009631371B2

(12) United States Patent
Suggate

(10) Patent No.: US 9,631,371 B2
(45) **Date of Patent: *Apr. 25, 2017**

(54) MODULAR AND COLLAPSIBLE RAMP SYSTEM

(71) Applicant: Trevor Ross Suggate, Albury (AU)

(72) Inventor: Trevor Ross Suggate, Albury (AU)

(73) Assignee: Australian Ramp Systems Pty Limited, Albury, New South Wales (AU)

( * ) Notice: Subject to any disclaimer, the term of this patent is extended or adjusted under 35 U.S.C. 154(b) by 54 days.

This patent is subject to a terminal disclaimer.

(21) Appl. No.: 15/098,261

(22) Filed: Apr. 13, 2016

(65) Prior Publication Data

US 2016/0251858 A1 Sep. 1, 2016

Related U.S. Application Data

(62) Division of application No. 14/406,513, filed on Dec. 8, 2014.

(51) Int. Cl.
*E04F 11/00* (2006.01)

(52) U.S. Cl.
CPC ..... *E04F 11/002* (2013.01); *E04F 2011/005* (2013.01)

(58) Field of Classification Search
CPC ..... E04F 11/18; E04F 11/181; E04F 11/002; E04F 11/1865; E04F 2011/005; B65G 69/28; B65G 69/30; B65G 69/2811; E04B 1/34331
See application file for complete search history.

(56) References Cited

U.S. PATENT DOCUMENTS

| | | | | | |
|---|---|---|---|---|---|
| 788,424 | A * | 4/1905 | Ochs | A01K 1/035 | 119/849 |
| 1,526,359 | A * | 2/1925 | Giles | E01D 2/02 | 14/73 |
| 2,308,943 | A * | 1/1943 | Tietig | E01D 2/02 | 119/525 |
| 2,706,662 | A * | 4/1955 | Brown | E04G 5/14 | 182/113 |
| 3,046,850 | A * | 7/1962 | Tellefson | B61D 23/02 | 114/201 R |

(Continued)

*Primary Examiner* — Abigail A Risic
(74) *Attorney, Agent, or Firm* — Michael Molins

(57) ABSTRACT

A ramp system has a plurality of modular components adapted to be interconnected in a desired configuration. The modular components include an entry ramp module (10, 80), an exit ramp module (80) and a landing module (100, 180) therebetween. Each modular component has a flow assembly (12), handrail assemblies (14, 16) and leg assemblies (18). Each of the handrail assemblies have posts (22, 24) which are adapted to support a handrail (26). The posts are collapsible by folding inwardly towards a deck (28) of the floor assembly through operation of a folding means (30) interconnecting the floor assembly and each post of the handrail assembly. The posts of the handrail assemblies are reversibly collapsible from an erect position, where the ramp system can be used and the handrail assemblies can support users of the ramp system, to a compact position where the ramp system can be stored, packaged and transported until required for assembly on site.

5 Claims, 13 Drawing Sheets

(56) References Cited

U.S. PATENT DOCUMENTS 3,106,826 A * 10/1963 Freidel ..... E02B 3/068 14/69.5
3,660,871 A * 5/1972 Boyle, Jr. ..... E04G 5/06 182/113
3,747,898 A * 7/1973 Warren ..... E04G 21/3233 182/113
3,836,106 A * 9/1974 Gray ..... E04G 5/00 24/350
3,881,698 A * 5/1975 Marsh ..... E04G 21/3233 248/231.41
3,995,833 A * 12/1976 McLaughlin ..... E04G 21/3233 248/231.41
4,669,577 A * 6/1987 Werner ..... E04G 21/3233 182/113
4,930,752 A * 6/1990 Wolper, Jr. ..... E01D 19/103 256/13.1
5,214,817 A * 6/1993 Allen ..... E04F 11/002 14/69.5
5,314,167 A * 5/1994 Holloman ..... E04G 21/3223 182/113
5,920,936 A * 7/1999 Wiedeck ..... E01D 15/124 14/13
6,526,614 B2 * 3/2003 Anderson ..... E01C 9/083 14/69.5
7,228,937 B2 * 6/2007 Morris ..... E04G 1/20 182/146
7,810,285 B1 * 10/2010 Liptak ..... E04F 11/1851 256/24
2002/0144364 A1 * 10/2002 Anderson ..... E01C 9/083 14/69.5
2004/0107519 A1 * 6/2004 Grody ..... A61G 3/061 14/69.5
2006/0059636 A1 * 3/2006 Suggate ..... E04F 11/002 14/69.5
2012/0036653 A1 * 2/2012 Peters ..... E04F 11/002 14/69.5
2013/0198978 A1 * 8/2013 Pohlman ..... E01D 1/00 14/69.5
2013/0236246 A1 * 9/2013 Whiteley ..... E01F 13/022 404/6
2014/0150188 A1 * 6/2014 Allen ..... E04F 11/002 14/69.5

* cited by examiner

DETAIL A

SECTION A-A REAR

SECTION A-A FRONT

DETAIL A

SECTION A-A REAR

SECTION A-A FRONT

SECTION A-A
SECTION B-B

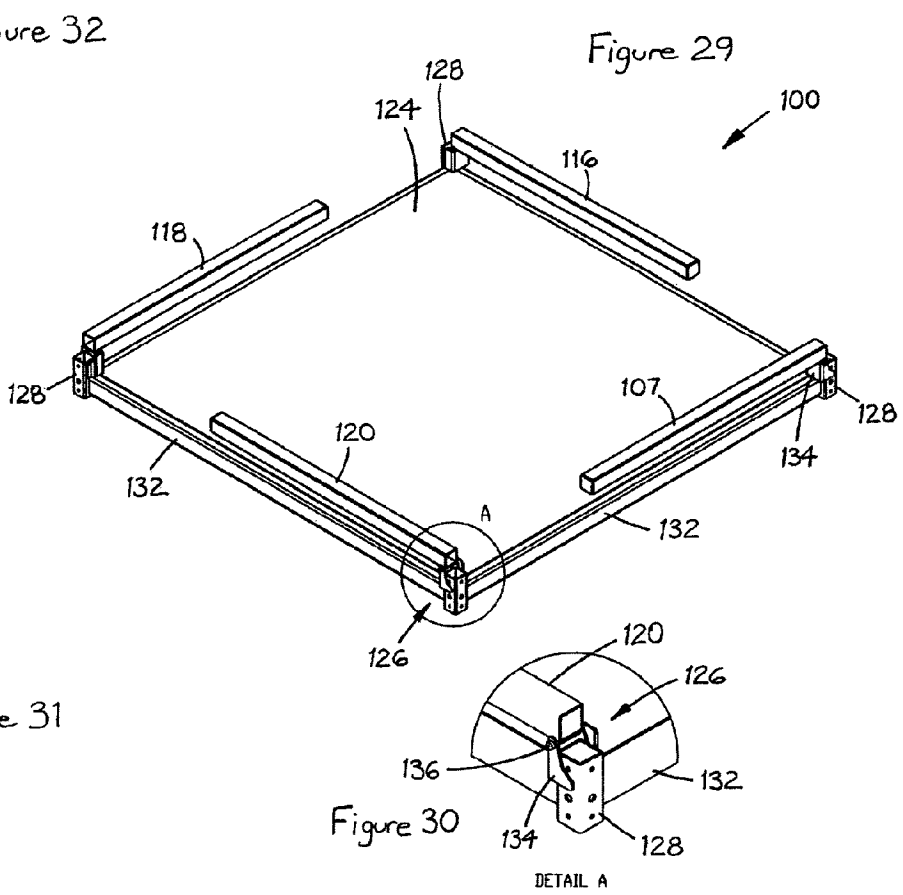
Figure 29
Figure 30
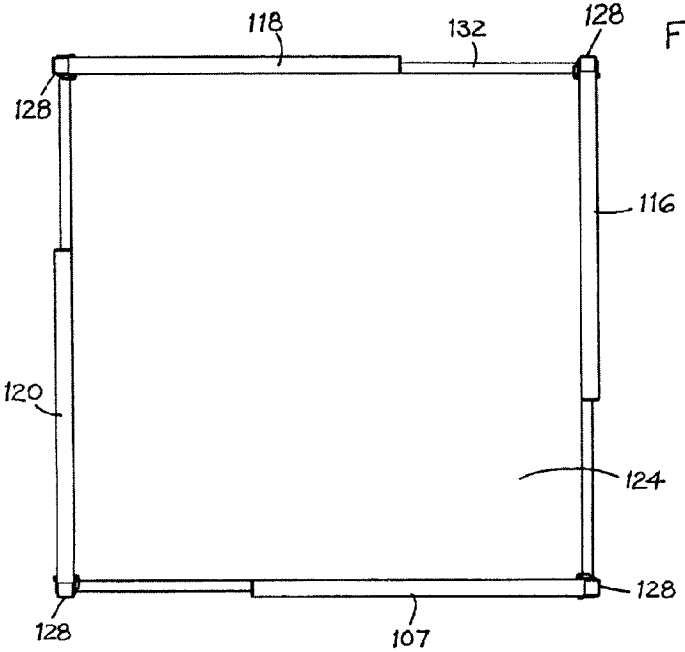
Figure 32
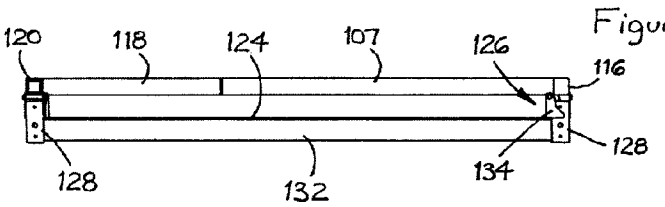
Figure 31

DETAIL A

DETAIL A

80

MODULAR AND COLLAPSIBLE RAMP SYSTEM

FIELD OF THE INVENTION

The present invention relates to a ramp system that can be assembled from modular components that are collapsible for storage, packaging and transportation purposes until required for assembly on site.

In this specification and claims, the term "ramp system" is intended to include in its meaning structural arrangements that include ramps, such as platforms or walkways with landings for which a ramp provides entry or exit.

The present invention also relates to a method of assembling a ramp system by interconnecting modular components, such as an entry ramp module, an exit ramp module and one or more landing module therebetween in a desired configuration, such as a straight through configuration, a left or right turn configuration, or a switchback configuration.

The present invention also relates to modular components for such a ramp system in which the modules include handrail assemblies that have posts which are adapted to support a handrail, the posts being reversibly collapsible by folding inwardly from an erect position towards a floor assembly of the module to assume a compact position.

The present invention still further relates to such ramp systems which are for reusable, temporary or permanent applications as required.

BACKGROUND OF INVENTION

U.S. Pat. No. 5,740,575 discloses a ramp kit comprising modular components that can be assembled to form ramp systems. The ramp kit includes a stand having support rails which extend between corresponding support posts, the rails being height adjustable to support an inclined ramp surface at a particular position along its length. However, the ramp system disclosed in this US patent has a number of significant limitations. Firstly, the support stand is relatively bulky, making it difficult to transport the components which are required to form a ramp system. Secondly, the range of height adjustment is quite limited and thirdly, height adjustment of each stand is reasonably time consuming as it involves alignment of holes formed in each end of two support rails with holes of support posts for subsequent insertion of two locating bolts.

Australian Patent Nos. 577,569 and 589,013 disclose modular component ramp kits having threaded support posts which are height adjustable to support an inclined ramp surface at a particular position along its length. Height adjustment is provided by threadable movement of a support nut along the length of the threaded support post. However, the ramp systems disclosed in these Australian patents appear to be quite cumbersome and costly to manufacture. Furthermore, their stability may be less than desirable in certain applications.

SUMMARY OF THE INVENTION

According to a first aspect of the present invention, there is provided a ramp system comprising a plurality of modular components adapted to be interconnected in a desired configuration, the modular components comprising at least one of an entry ramp module, an exit ramp module and a landing module therebetween, each modular component comprising a floor assembly, handrail assemblies and leg assemblies, each of the handrail assemblies comprising posts which are adapted to support a handrail, the posts being collapsible by folding inwardly towards a deck of the floor assembly through operation of a folding means interconnecting the floor assembly and each post of the handrail assembly, the posts of the handrail assemblies being reversibly collapsible from an erect position, where the ramp system can be used and the handrail assemblies can support users of the ramp system, to a compact position, where the ramp system can be stored, packaged and transported until required for assembly on site.

Preferably, the folding means comprises a bracket and a fixed pivot pin, the bracket having a first end which receives the pivot pin so as to be pivotally mounted thereabout, and having a second end which is connected to a lower portion of a post of the handrail assembly, the pivot pin being mounted to the floor assembly.

In a preferred form, the folding means further comprises a retaining clip having a planar first end secured to the bracket at a location above the pivot pin, and having a curved second end engaging around a part circumferential portion of the pivot pin and maintaining said engagement as the handrail assembly pivots between the erect position and the compact position, the curved second end of the retaining clip sliding over the part circumferential portion of the pivot pin during such pivoting.

It is preferred that the fixed pivot pin is mounted to the outside of an upright kick plate portion of the floor assembly.

Preferably, the bracket comprises a main plate and a pair of side plates integrally connected to respective opposed sides of the main plate, the first end of the bracket comprising a pair of openings in the respective bottom ends of the pair of side plates and through which pair of openings the fixed pivot pin is received.

In a further preferred form, the kick plate portion of the floor assembly has a cut-out region comprising a first side edge and a second side edge facing the first side edge, the fixed pivot pin having a first end mounted to the first side edge of the cut-out region and having a second end mounted to the second side edge of the cut-out region, the bracket passing pivotally through the cut-out region as the post of the handrail assembly pivots between the erect position and the compact position.

Preferably, the bracket is located substantially on the outside of the kick plate portion when the post of the handrail assembly is in the erect position, and is located substantially on the inside of the kick plate portion when the post of the handrail assembly is in the compact position.

BRIEF DESCRIPTION OF THE DRAWINGS

In order that the invention may be more readily understood and put into practical effect, reference will now be made to the accompanying drawings, in which:

FIG. 29 is a perspective view of the landing module of FIG. 23 in which the handrails have been removed and the posts are in the compact position, FIG. 30 is a detailed perspective view of the circled portion labelled A of the landing module as shown in FIG. 29, showing a second folding means interconnecting a floor assembly and a post of a handrail assembly, FIG. 31 is a side view of the landing module as shown in FIG. 29, FIG. 32 is a top view of the landing module as shown in FIG. 29.

BEST MODE OF CARRYING OUT THE INVENTION

Figures 1, 2, 3, 4, 5, 6, 7:
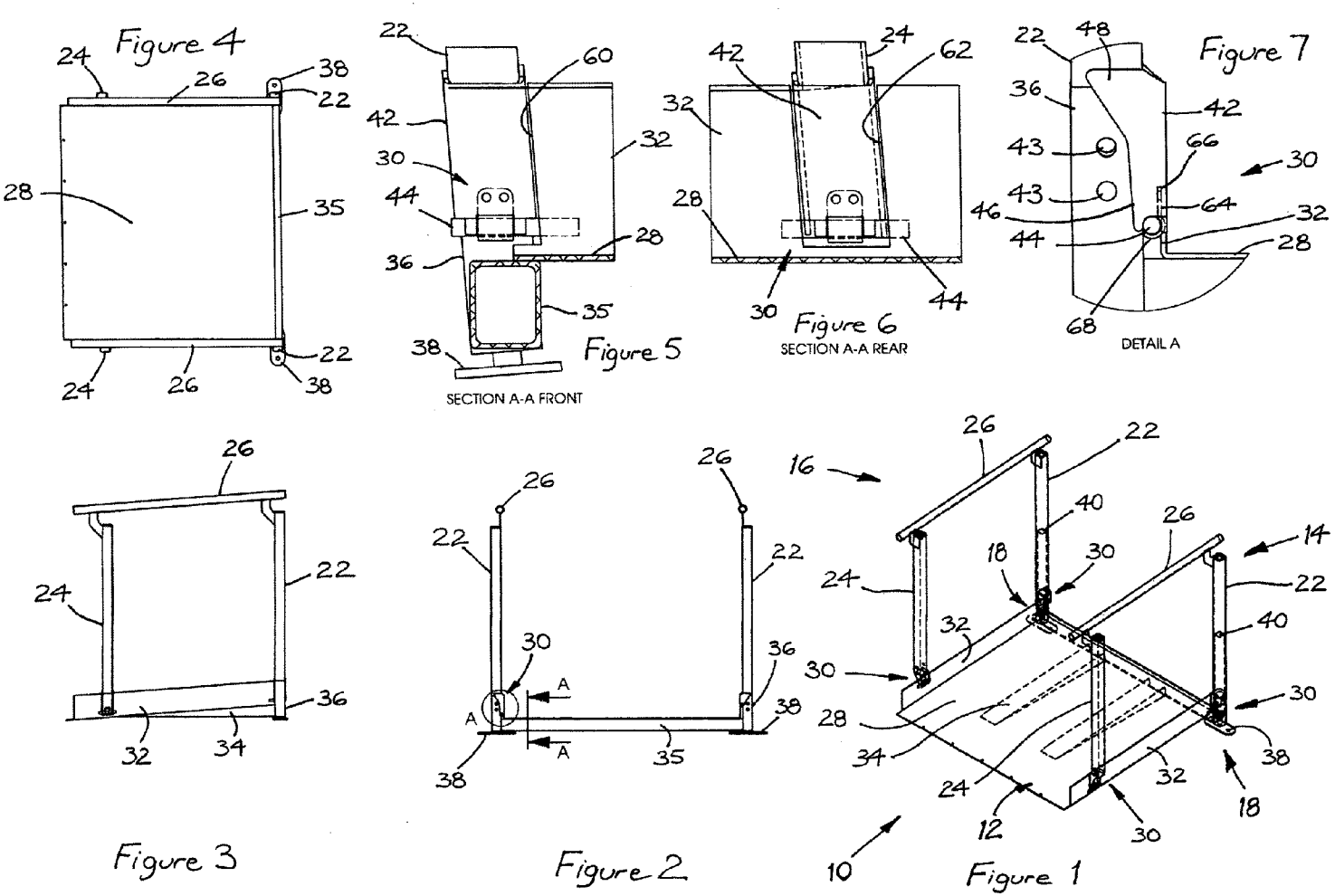
FIG. 1 is a perspective view of a first ramp module of a ramp system according to one preferred embodiment of the invention, in which the handrail assemblies are in the erect position.
FIG. 2 is a rear view of the ramp module as shown in FIG. 1.
FIG. 3 is a side view of the ramp module as shown in FIG. 1.
FIG. 4 is a top view of the ramp module as shown in FIG. 1.
FIG. 5 is a sectional view through A-A of a first folding means interconnecting a floor assembly and a handrail assembly at the rear of the ramp module as shown in FIG. 1.
FIG. 6 is a sectional view through A-A of a second folding means interconnecting the same floor and handrail assemblies as in FIG. 5 but at the front of the ramp module as shown in FIG. 1.
FIG. 7 is a detailed view of the circled portion labelled A of the ramp module as shown in FIG. 2.
Figure 8:
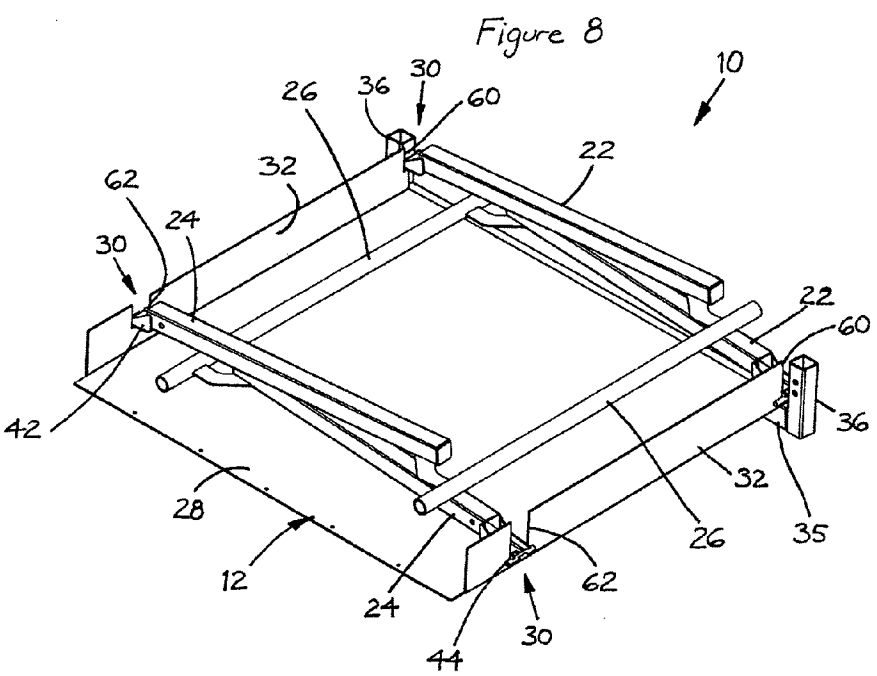
FIG. 8 is a perspective view of the first ramp module of FIG. 1 in which the handrail assemblies are in the compact position.
Figure 9:
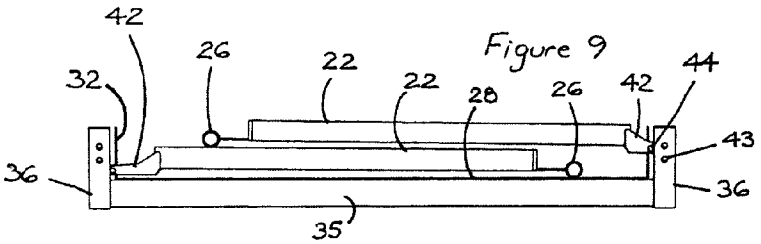
FIG. 9 is a front view of the ramp module as shown in FIG. 8.
Figure 10:
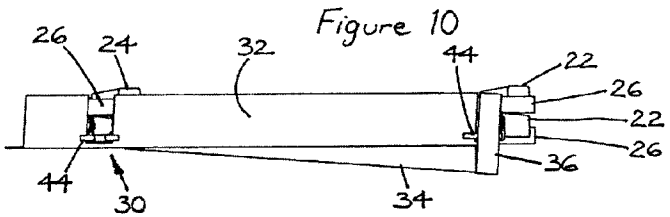
FIG. 10 is a side view of the ramp module as shown in FIG. 8.
Figure 11:
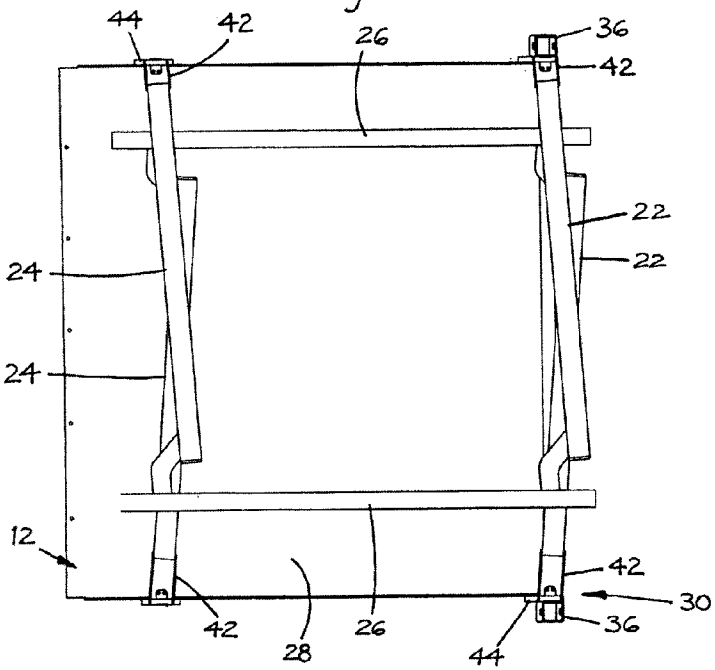
FIG. 11 is a top view of the ramp module as shown in FIG. 8.

FIGS. 1 to 11 depict a first ramp module 10 of a preferred ramp system of the invention. The ramp module 10 is a modular component of a ramp system that includes other modular components which are interconnected in a desired configuration. The ramp module 10 may serve as either an entry ramp module or an exit ramp module, or may serve as both of these, in a ramp system of a desired configuration.

The ramp module 10 includes a floor assembly 12, a pair of opposed side handrail assemblies 14, 16 which are collapsible, and a pair of leg assemblies 18.

Each handrail assembly 14, 16 includes a pair of posts 22, 24 which support a respective handrail 26, and can be collapsed, only after an inner post 40 of the respective leg assembly 18 has been removed from within the respective post 22 so that each handrail assembly 14, 16 is in a ready to compact condition, by folding the posts of the handrail assembly inwardly towards a deck 28 of the floor assembly 12 through operation of a folding means 30 which interconnects an upright kick plate portion 32 of the floor assembly 12 and a post 22, 24 of the handrail assembly 14, 16. There are two kick plate portions 32 extending upwardly from respective opposite sides of the deck 28.

Each handrail assembly 14, 16 is reversibly collapsible from an erect position, such as is shown in FIGS. 1 to 7, where the inner post 40 of each leg assembly 18 is within the respective post 22, and the ramp module 10 can be used as a component of a ramp system and the handrail assemblies can support users of the ramp system, to a compact position, such as is shown in FIGS. 8 to 11, where the inner post 40 of each leg assembly 18 has been removed from within the respective post 22, and the ramp module 10, along with the other reversibly collapsed components of the ramp system, can be stored, packaged and transported until required for assembly on site.

Figure 37:
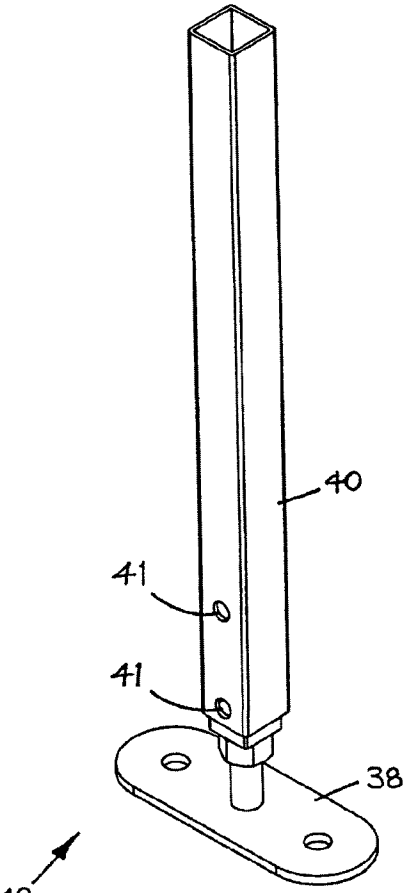
FIG. 37 is a perspective view of an inner post with foot of a leg assembly for a module of the ramp system according to a preferred embodiment of the invention.

The floor assembly 12 has angled load support members 34 beneath the deck 28, and has a cross-beam 35 supporting the elevated rear end of the deck 28. The deck 28 is inclined upwardly to a desired degree from a front end to the rear end of the ramp module 10 (see, for example, FIG. 3). The front end of the ramp module 10 may be supported directly upon the ground, but the rear end is supported upon the ground via the pair of opposing leg assemblies 18 which engage with respective post sockets 36 of the floor assembly. Each leg assembly 18 (as shown in FIG. 37) has a foot 38 which is supported directly upon the ground and has an inner post 40 which passes through the post socket 36 from beneath. The inner post 40 has leg length adjustment holes 41, a selected one of which can be superimposed over a selected one of similarly sized holes 43 through a post socket 36, and a bolt, locking pin or other fastening device may be inserted and retained through the superimposed holes to maintain the desired vertical length from the foot 38 to the post socket 36. The corresponding post 22 of the handrail assembly then passes over the inner post 40 from above and its leading end is held in position by abutting the post socket 36.

Figure 35:
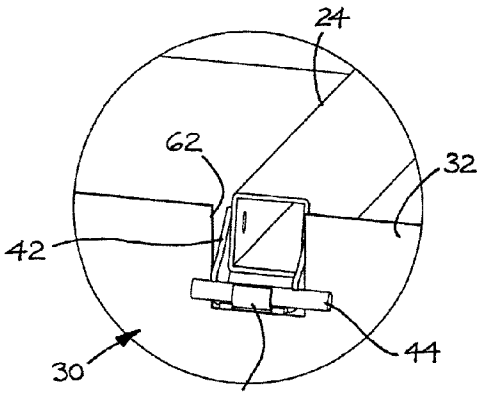
FIG. 35 is a detailed perspective view of the circled portion labelled A but when the handrail assembly is in the compact position, showing a first folding means interconnecting a floor assembly and a handrail assembly and having been operated to fold the handrail assembly inwardly towards a deck of the floor assembly.
Figure 36:
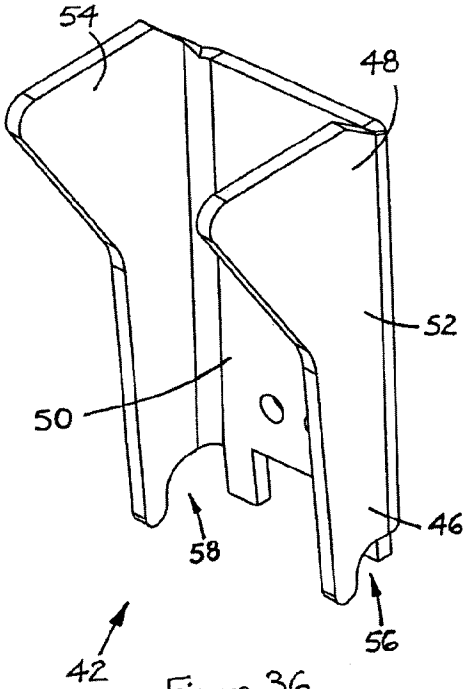
FIG. 36 is a perspective view of a bracket of the first folding means for the first and second ramp modules.

The folding means 30, shown in more detail in FIGS. 5 to 7 and 34 when the handrail assembly is in the erect position, and in FIG. 35 when the handrail assembly is in the compact position, has a bracket 42 and a fixed pivot pin 44. The bracket 42 has a lower first end 46 which receives the pivot pin 44. The bracket 42 is pivotally mounted about the pivot pin 44. The pivot pin 44 is mounted to the outside of kick plate portion 32 of the floor assembly. The bracket 42 has an upper second end 48 which is connected to a lower portion of a respective post 22, 24 of the handrail assembly. As best shown in FIG. 36, the bracket 42 has a main plate 50 and a pair of side plates 52, 54 integrally connected to respective opposed sides of the main plate. The first end 46 of the bracket 42 has a pair of openings 56, 58 in the respective bottom ends of the pair of side plates 52, 54. The fixed pivot pin 44 is received through these openings 56, 58.

Figure 34:
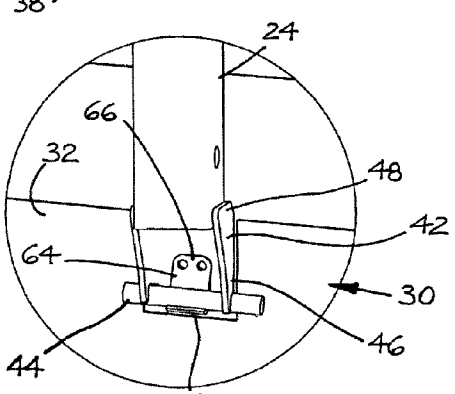
FIG. 34 is a detailed perspective view of the circled portion labelled A of the ramp module as shown in FIG. 33.

Both of the kick plate portions 32 of the floor assembly 12 have cut-out regions 60, 62 (cut-out region 62 is best shown in FIGS. 34 and 35). The fixed pivot pin 44 has a first end mounted to a first side edge of the cut-out region 60, 62 and has a second end mounted to a second side edge of the cut-out region 60, 62. In operation of the folding means 30, the bracket 42 passes pivotally through its respective cut-out region 60, 62 as the handrail assembly 14, 16 pivots between the erect position and the compact position.

The bracket 42 is located substantially on the outside of the kick plate portion 32 when the handrail assembly 14, 16 is in the erect position, and is located substantially on the inside of the kick plate portion 32 when the handrail assembly 14, 16 is in the compact position. This is particularly advantageous as the bracket 42 will not obstruct any part of the deck 28 of the floor assembly 12 when the handrail assembly is in the erect position and the ramp system 10 can be used, and the bracket 42 will not protrude on the outside of the kick plate portion 32 of the floor assembly 12 when the handrail assembly 14, 16 is in the compact position and the ramp system 10 can be stored, packaged and transported without the bracket 42 taking up more space.

The folding means 30 also has a retaining clip 64 for retaining the bracket 42, and thus retaining its connected post of a handrail assembly, in all its positions (including the erect and compact positions and all positions therebetween) relative to the floor assembly 12. The retaining clip 64 (which is best shown in FIGS. 34 and 35) may be made of any resilient material, and has a planar first end 66 which is secured to the bracket 42 at a location above the pivot pin 44 (when viewed with the handrail assembly in the erect position) and has a curved second end 68 which is engaged around a part circumferential portion of the pivot pin 44. The curved second end 68 of the retaining clip 64 maintains its engagement with the pivot pin 44 by sliding over the part circumferential portion of the pin 44 as the handrail assembly pivots between the erect position and the compact position. The retaining clip 64 is configured, if required, to release the bracket 42, and thus release the post of the handrail assembly, from its retained position to the fixed pivot pin 44.

FIGS. 12 to 22 and 33 depict a second ramp module 80 of a preferred ramp system of the invention. The purpose and function of the ramp module 80 may be the same as that of the ramp module 10. Apart from the length of the ramp modules 10 and 80 (module 10 is 0.9 metres long and module 80 is 1.8 metres long), there is very little other structural difference between the modules 10 and 80. Therefore, like features between the ramp modules 10 and 80 are identified in ramp module 80 with like numerals. The earlier description of the structure and function of those like features in ramp module 10 also applies herein as a description of the structure and function of those features in ramp module 80.

Figures 12, 13, 14, 15, 16, 17, 18:
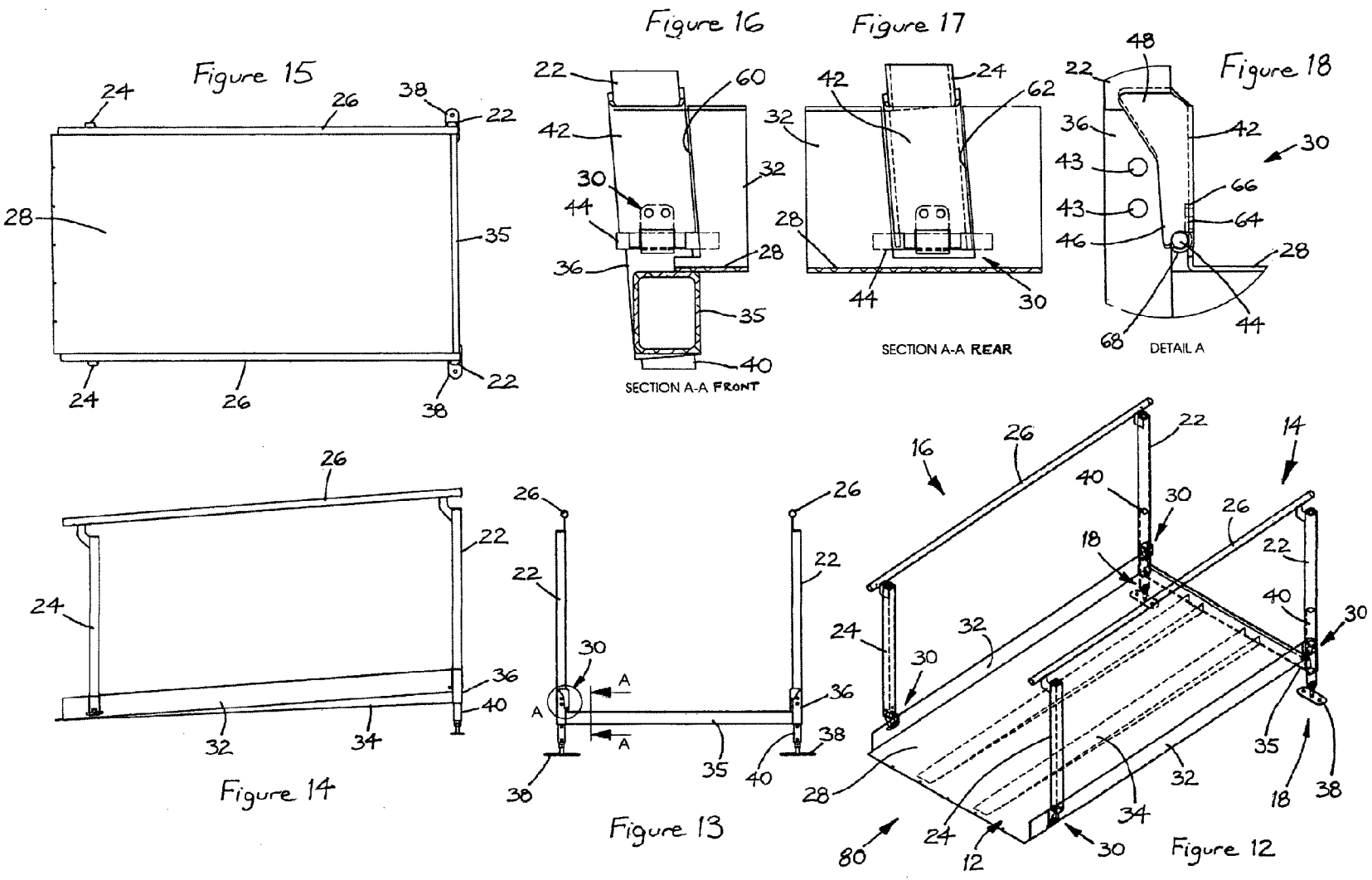
FIG. 12 is a perspective view of a second ramp module of a ramp system according to another preferred embodiment of the invention, in which the handrail assemblies are in the erect position.
FIG. 13 is a rear view of the ramp module as shown in FIG. 12.
FIG. 14 is a side view of the ramp module as shown in FIG. 12.
FIG. 15 is a top view of the ramp module as shown in FIG. 12.
FIG. 16 is a sectional view through A-A of a first folding means interconnecting a floor assembly and a handrail assembly at the rear of the ramp module as shown in FIG. 12.
FIG. 17 is a sectional view through A-A of a second folding means interconnecting the same floor and handrail assemblies as in FIG. 16 but at the front of the ramp module as shown in FIG. 12.
FIG. 18 is a detailed view of the circled portion labelled A of the ramp module as shown in FIG. 13.
Figure 19:
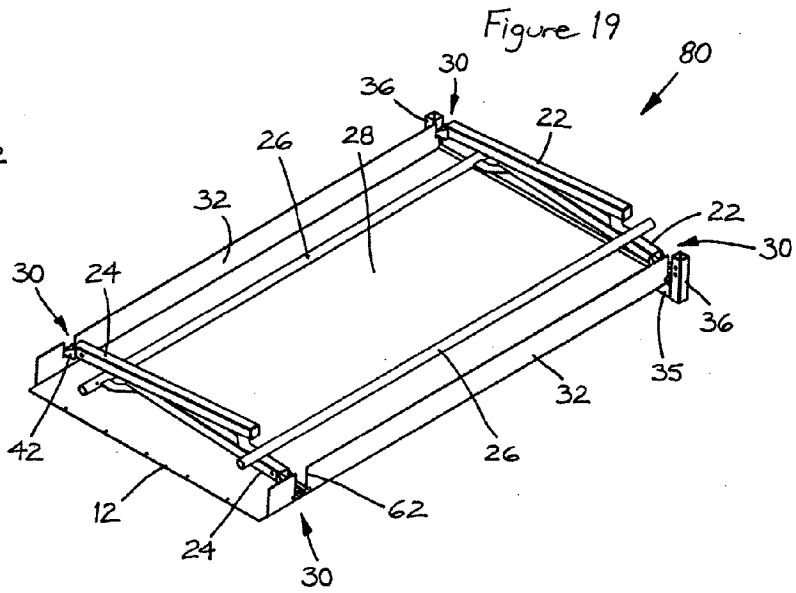
FIG. 19 is a perspective view of the second ramp module of FIG. 12 in which the handrail assemblies are in the compact position.
Figure 20:
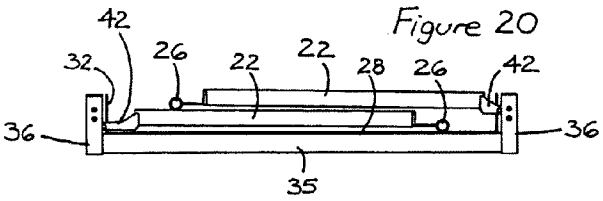
FIG. 20 is a front view of the ramp module as shown in FIG. 19.
Figure 22:
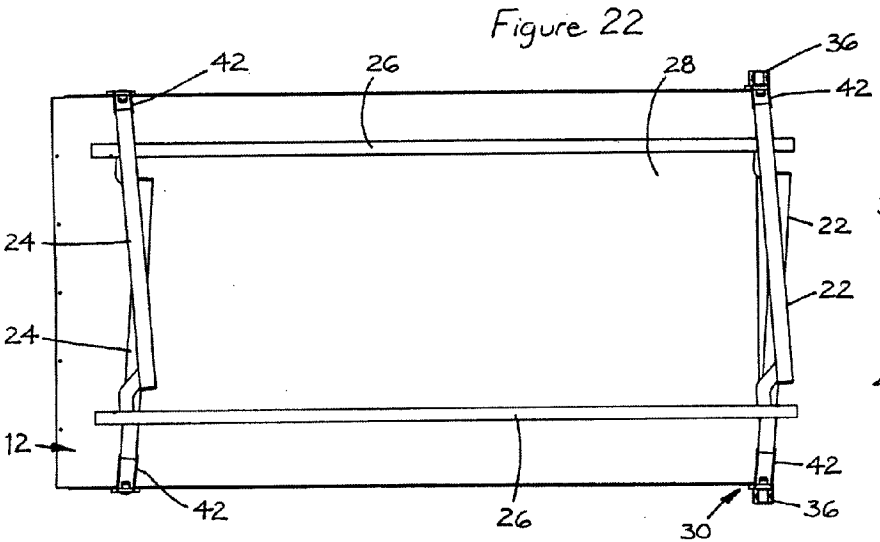
FIG. 22 is a top view of the ramp module as shown in FIG. 19.
Figure 21:
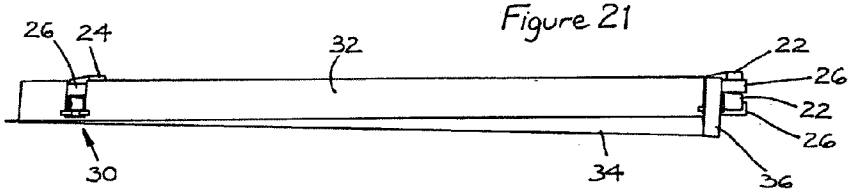
FIG. 21 is a side view of the ramp module as shown in FIG. 19.
Figure 42:
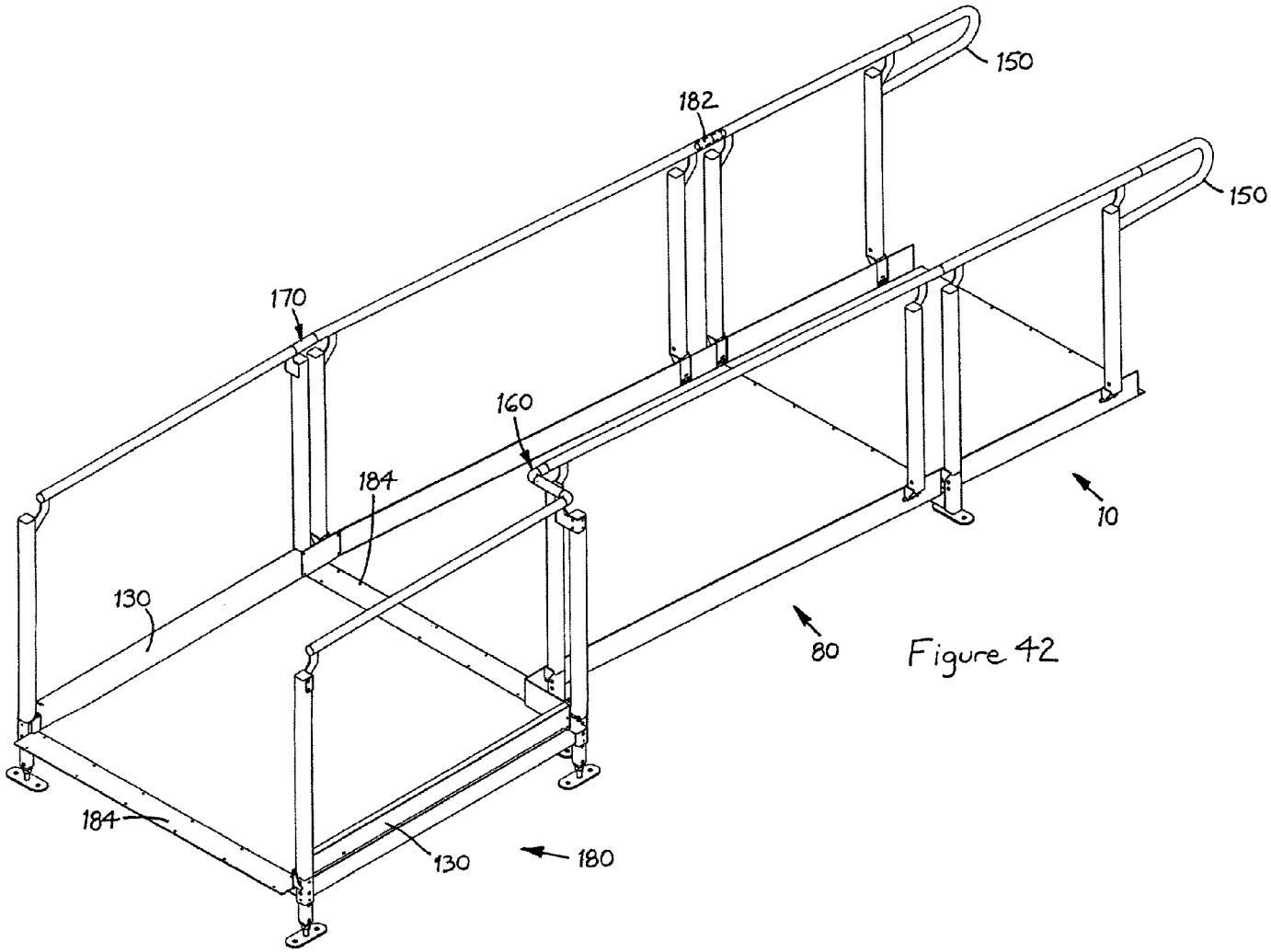
FIG. 42 is a perspective view of a ramp system according to a preferred embodiment of the invention in a first desired straight through configuration.
Figure 43:
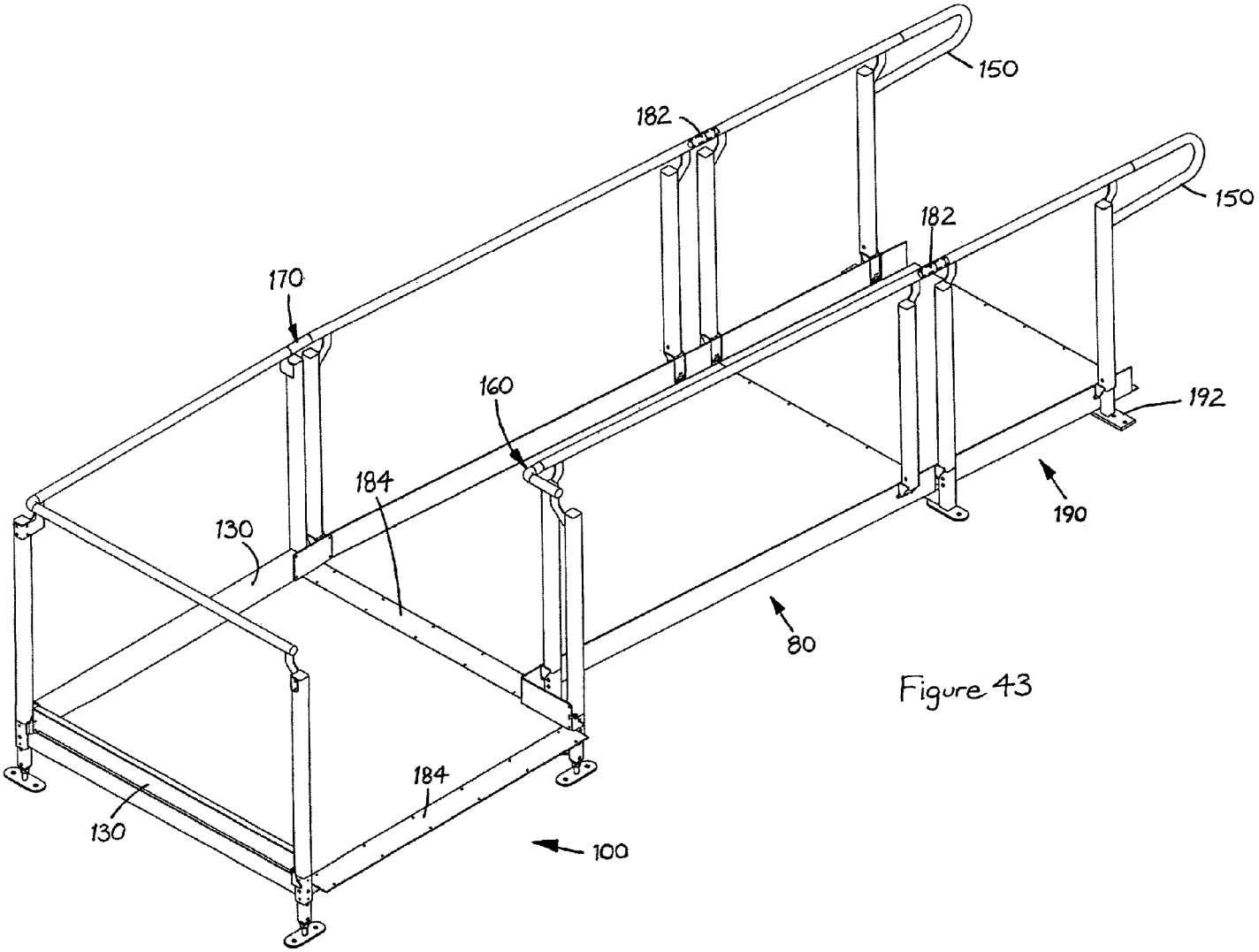
FIG. 43 is a perspective view of a ramp system according to a preferred embodiment of the invention in a second desired corner configuration.
Figure 44:
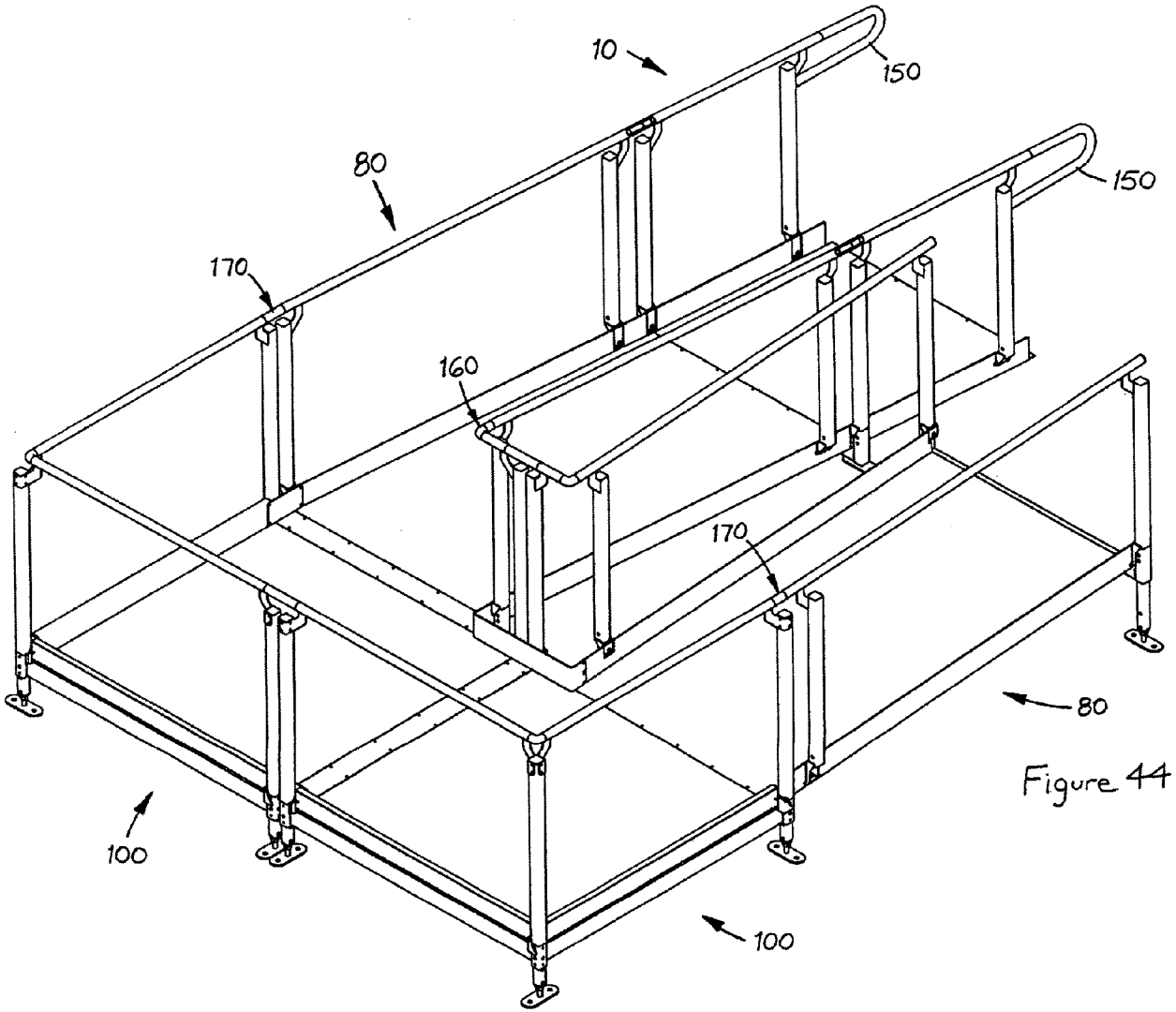
FIG. 44 is a perspective view of a ramp system according to a preferred embodiment of the invention in a third desired switchback configuration.

It is noted, however, that the desired vertical length from each foot 38 to the post socket 36 is larger in the ramp module 80 as shown in FIG. 13 than it is in the ramp module 10 as shown in FIG. 2. This increased height at the rear end of the deck 28 of the ramp module 80 may be selected so that the module 80 can be used as the only entry and/or exit ramp module in the desired configuration of ramp system, such as when a landing module for which the ramp module 80 provides entry or exit, needs to be high off the ground and the deck 28 needs to be inclined at a steeper angle than that of the deck 28 in ramp module 10. The module 80 can alternatively be used as a second entry ramp module connected at its front end to the rear end of, say, ramp module 10 in circumstances where the deck 28 does not need to be inclined at the steeper angle. Examples of some of these configurations are shown in FIGS. 42 to 44.

FIGS. 23 to 32 depict a landing module 100 of a preferred ramp system of the invention. The landing module 100 is a modular component of a ramp system that includes other modular components, such as ramp modules 10 and 80, which are interconnected in a desired configuration.

The landing module 100 includes a floor assembly 102, a pair of adjoining corner handrail assemblies 104, 106, a free standing corner post 107, and four leg assemblies 18 which are similar in structure and function to the leg assemblies 18 in ramp modules 10, 80.

Each handrail assembly 104, 106 includes a pair of posts 116, 118 and 118, 120, respectively, which support a respective handrail 122. Each handrail assembly 104, 106 and the corner post 107 can be collapsed, only after the handrails 122 have been removed and an inner post 40 of the respective leg assembly 18 has been removed from within the respective post 107, 116, 118, 120 so that each post 116, 118, 120 of the handrail assembly 104, 106 and the corner post 107 is in a ready to compact condition, by folding the posts 107, 116, 118, 120 inwardly towards a deck 124 of the floor assembly 102 through operation of a folding means 126 which interconnects a post socket 128 at each corner of the floor assembly 102 and a post 107, 116, 118, 120.

Each post 107, 116, 118, 120 is reversibly collapsible from an erect position, such as is shown in FIGS. 23 to 28, where the inner post 40 of each leg assembly 18 is within the respective post 107, 116, 118, 120, and the landing module 100 can be used as a component of a ramp system and the handrail assemblies can support users of the ramp system, to a compact position, such as is shown in FIGS. 29 to 32, where the inner post 40 of each leg assembly 18 has been removed from within the respective post 107, 116, 118, 120, and the landing module 100, along with the other reversibly collapsed components of the ramp system, can be stored, packaged and transported until required for assembly on site.

The floor assembly 102 has kerb rails 130 extending along the edges of the deck 124 beneath the handrails 122, and has cross-beams 132 supporting all four side edges of the deck 124. The deck 124 is horizontal and all four corners are supported upon the ground via the leg assemblies 18 which engage with respective post sockets 128 of the floor assembly 102.

Figures 23, 24, 25, 26, 27, 28:
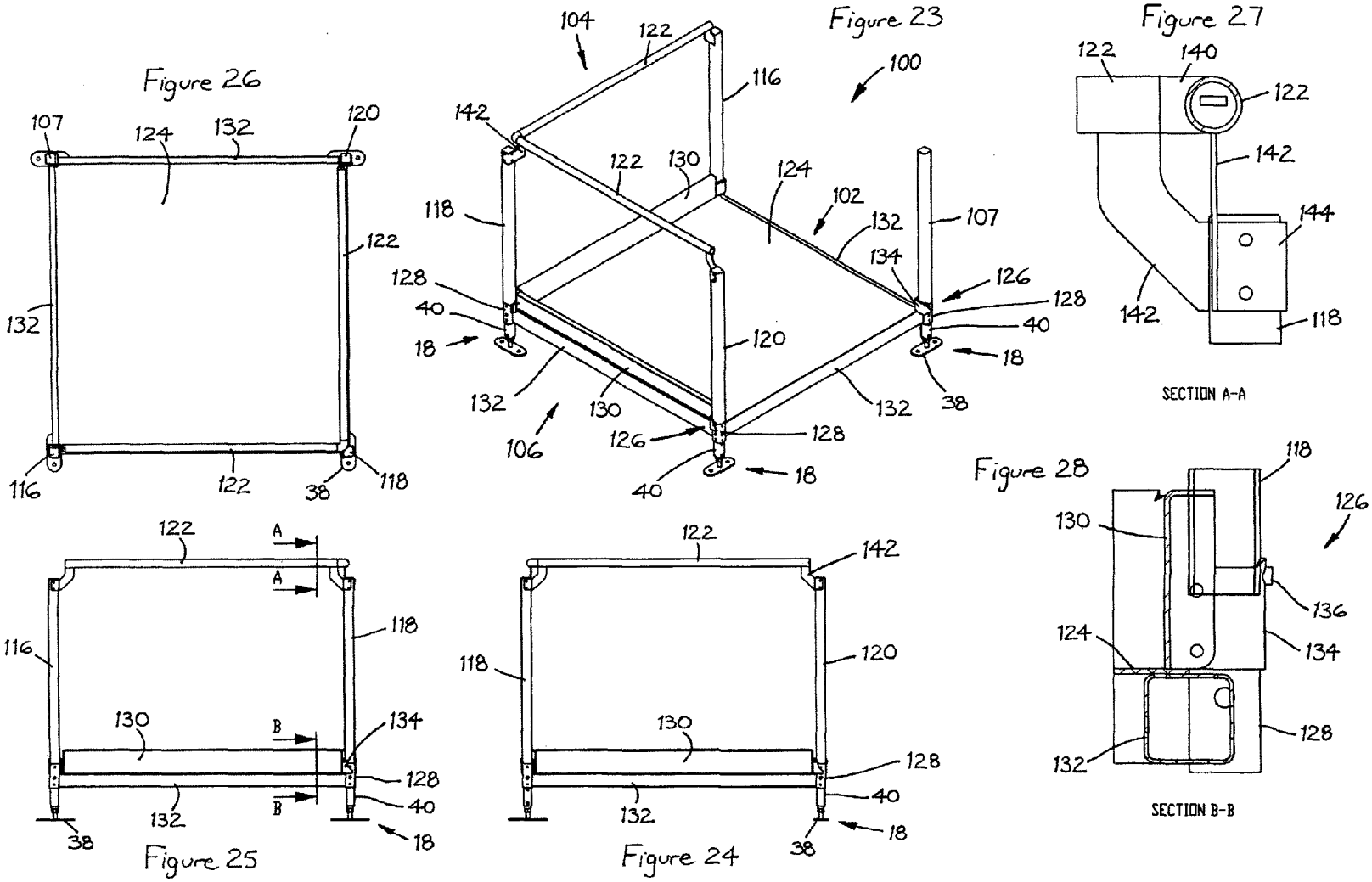
FIG. 23 is a perspective view of a landing module of a ramp system according to another preferred embodiment of the invention, in which the handrail assemblies are in the erect position.
FIG. 24 is a front view of the landing module as shown in FIG. 23.
FIG. 25 is a rear view of the landing module as shown in FIG. 23.
FIG. 26 is a top view of the landing module as shown in FIG. 23.
FIG. 27 is a sectional view through A-A of the landing module as shown in FIG. 25, showing the interconnection of two adjacent corner handrails to each other and to a post.
FIG. 28 is a sectional view through B-B of the landing module as shown in FIG. 25, showing a second folding means interconnecting a floor assembly and a post of a handrail assembly.

The folding means 126, shown in more detail in FIG. 28 when the post 118 is in the erect position and in FIG. 30 when the post 120 is in the compact position, has a bracket 134 and a fixed pivot pin 136.

The bracket 134 has a lower first end which is mounted to the post socket 128 and has an upper second end which engages the pivot pin 136. The pivot pin 136 is mounted to a bottom side surface of the post 120 and has opposed first and second ends that protrude from opposite edges of the bottom side surface of the post 120. The upper second end of the bracket 134 has one or more holes through which are engaged the protruding first and second ends of the pivot pin 136.

The bracket 134 is mounted to each of the four post sockets 128 in such a way that, in operation of the folding means 126, the posts 107, 116, 118, 120 pivot between the erect position and the compact position through a vertical plane and, when in the compact position, lay horizontally above the deck 124 (as best shown in FIG. 31). As shown in FIGS. 29 and 32, the posts, when in the compact position, are all arranged in a clockwise direction (when viewed from above the landing module 100), although they may alternatively be all arranged in an anticlockwise direction if the brackets are mounted to each post socket in a different way. This ensures that the height of the landing module in the compact position is as low as possible, as there is no overlapping of the posts.

Referring to FIG. 27, the two adjacent corner handrails 122 of the landing module 100 are interconnected to each other and to the post 118. A corner connector piece 140 has opposed male ends which engage firmly within respective female ends of the adjacent corner handrails 122. Extending downwardly from each end of a handrail 122 is a spacing elbow panel 142, which terminates in an L-shaped bracket 144. The L-shaped brackets 144 are so configured that, for post 118, an L-shaped bracket 144 from a first handrail 122 can engage a first pair of adjoining corner surfaces of the post 118, and an L-shaped bracket 144 from a second handrail 122, which is adjacent to and defines a corner with the first handrail 122, can engage a second pair of adjoining corner surfaces of the post (which are not already engaged by the L-shaped bracket 144 from the first handrail 122).

Figures 38, 39:
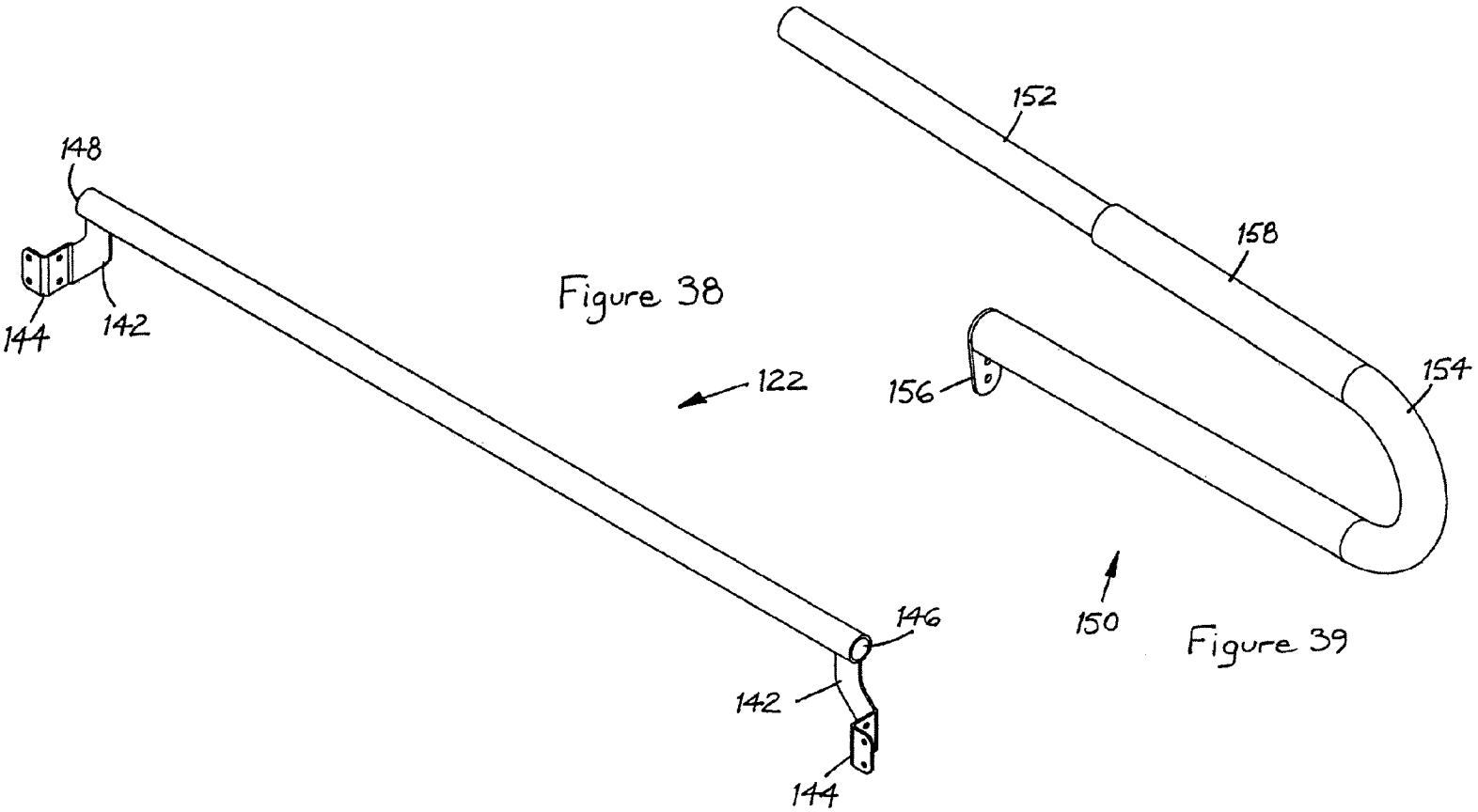
FIG. 38 is a perspective view of a handrail of a handrail assembly for a landing module of the ramp system according to a preferred embodiment of the invention.
FIG. 39 is a perspective view of an entry handrail for connection to a ramp module of the ramp system according to a preferred embodiment of the invention.

Referring to FIG. 38, a handrail 122 of the landing module 100 has opposed female ends 146, 148, from each, of which extends downwardly a spacing elbow panel 142 which terminates in an L-shaped bracket 144. Each L-shaped bracket 144 of handrail 122 is so configured to engage a respective post in the manner described above with reference to the L-shaped brackets 144 of the two adjacent corner handrails 122 which engage the post 118.

Figure 33:
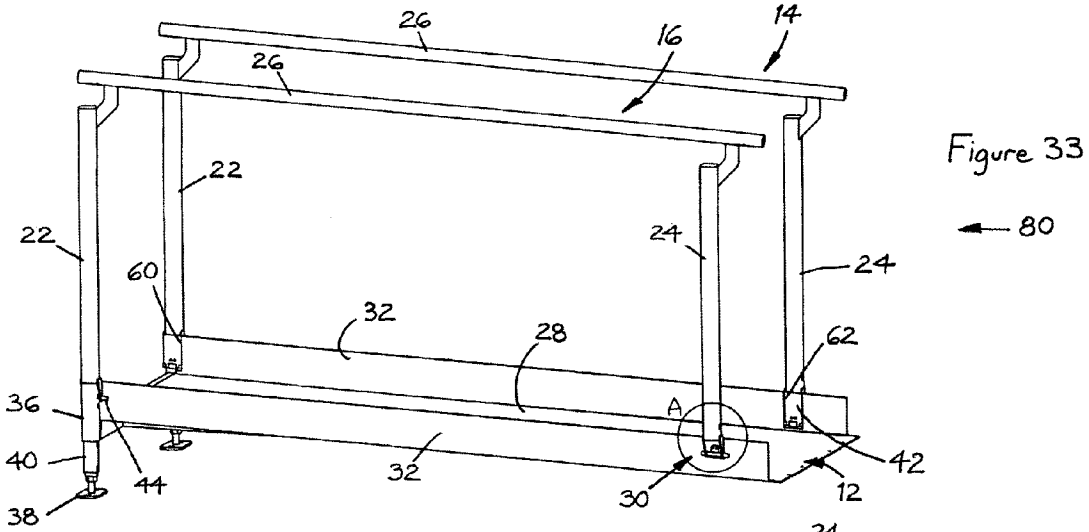
FIG. 33 is another perspective view of the second ramp module as shown in FIG. 12.

FIG. 39 depicts an entry handrail 150 that may be used on a ramp module, such as ramp modules shown in FIGS. 1, 12 and 33. The entry handrail 150 has an upper male end 152 which may engage firmly within a female end of a handrail 26, a curved rail portion 154, and a lower plate 156 for engaging, such as with bolts, a surface of a post 24 of the ramp module. The male end 152 may be telescopically extendable within a straight upper region 158 of the curved rail portion 154.

Figure 40:
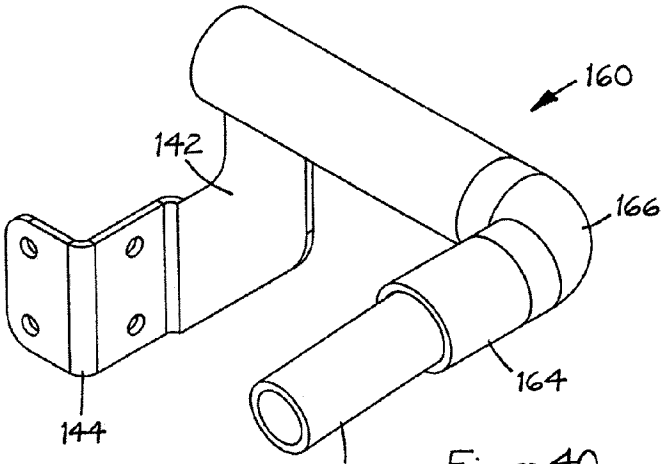
FIG. 40 is a perspective view of a first handrail connector for connecting handrails extending at right angles to each other, the so interconnected handrails defining a corner of the ramp system according to a preferred embodiment of the invention.

FIG. 40 depicts a first handrail connector 160 for connecting handrails extending at right angles to each other. Handrails interconnected by the connector 160 define a corner of the ramp system between a ramp module and a landing module. The handrail connector 160 has a male end 162 which is formed at a slight angle of inclination to a straight arm 164 of a curved connector portion 166. The male end 162 may engage firmly within a female end of a handrail 26 of a ramp module. At the other end is a downwardly extending spacing elbow panel 142 which terminates in an L-shaped bracket 144 for engaging a post.

Figure 41:
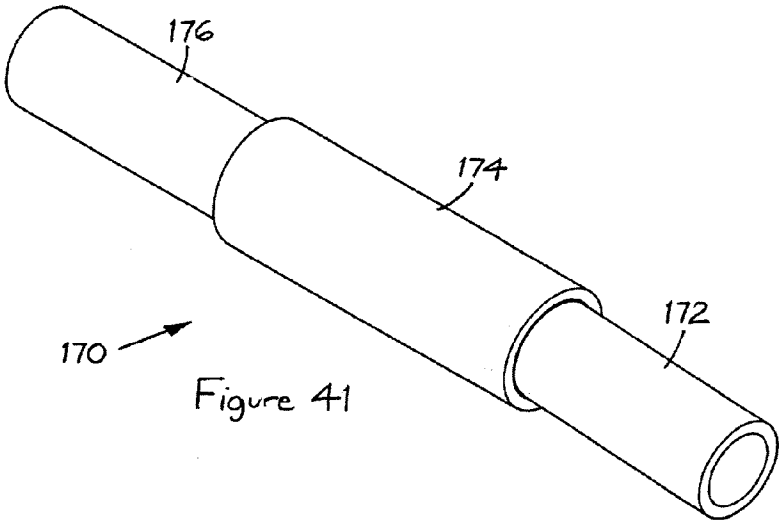
FIG. 41 is a perspective view of a second handrail connector for connecting handrails that are aligned to each other, the so interconnected handrails defining a continuity where a ramp module is connected to a landing module of the ramp system according to a preferred embodiment of the invention.

FIG. 41 depicts a second handrail connector 170 for connecting handrails that are aligned to each other, but inclined relative to each other. Handrails interconnected by the connector 170 define a continuity of the ramp system between a ramp module and a landing module. The handrail connector 170 has a first male end 172 which is formed at a slight angle of inclination to a straight sleeve 174. The first male end 172 may engage firmly within a female end of a handrail 26 of a ramp module. At the other end is a straight male end 176, which may be directly connected through the sleeve 174 to the first male end 172, for engaging firmly within a female end of an aligned and adjoining handrail of a landing Module. The straight male end 176 may be telescopically extendable within the straight sleeve 174.

The straight through configuration of the ramp system shown, by way of example, in FIG. 42 utilizes the ramp module 10 (as shown in FIGS. 1 to 11) at the entry end of the ramp system, the ramp module 80 (as shown in FIGS. 12 to 22 and 33) connected to the exit end of the ramp module 10, and a landing module 180 (similar to landing module 100 as shown in FIGS. 23 to 32 but with handrails rearranged). Connected to the ramp module 10 is a pair of entry handrails 150. The handrails of ramp modules 10, 80 are interconnected by a third handrail connector 182 which is a straight bar that engages firmly within both of the facing female ends of the aligned and adjoining handrails of the ramp modules. The ramp system shown in FIG. 42 also utilizes a "corner defining" first handrail connector 160 and a "continuity defining" second handrail connector 170. The decks of the ramp module 80 and the landing module 180 are interconnected by a transition plate 184.

The corner configuration of the ramp system shown, by way of example, in FIG. 43 utilizes a ramp module 190 (similar to ramp module 10 but with foot plate or leg assemblies 192 at the entry end of the module) at the entry end of the ramp system, the ramp module 80 connected to the exit end of the ramp module 190, and the landing module 100. In most other respects, the ramp system shown in FIG. 43 is similar to the ramp system shown in FIG. 42, and so like features are identified with like numerals.

The switchback configuration of the ramp system shown, by way of example, in FIG. 44 utilizes the ramp module 10 (as the entry ramp module), a pair of ramp modules 80 (one of which is the exit ramp module), and a pair of landing modules 100. It will be apparent from this configuration and those shown in FIGS. 42 and 43, that the configuration of modules can be varied in many different ways to suit the application or needs of the user.

It will also be readily apparent to persons skilled in the art that various modifications may be made in details of design and construction of the ramp system as described above without departing from the scope or ambit of the invention.

The invention claimed is:

1. A ramp system comprising a plurality of modular components adapted to be interconnected in a desired configuration, the modular components comprising at least one of an entry ramp module, an exit ramp module and a landing module therebetween, each modular component comprising a floor assembly, handrail assemblies and leg assemblies, each of the handrail assemblies comprising posts which are adapted to support a handrail, the posts being collapsible by folding inwardly towards a deck of the floor assembly through operation of a folding means interconnecting the floor assembly and each post of the handrail assembly, the posts of the handrail assemblies being reversibly collapsible from an erect position, where the ramp system can be used and the handrail assemblies can support users of the ramp system, to a compact position, where the ramp system can be stored, packaged and transported until required for assembly on site, wherein the folding means comprises a bracket and a fixed pivot pin, the bracket having a first end which receives the pivot pin so as to be pivotally mounted thereabout, and having a second end which is connected to a lower portion of a post of the handrail assembly, the pivot pin being mounted to the floor assembly, and wherein the folding further means comprises a retaining clip having a planar first end secured to the bracket at a location above the pivot pin, and having a curved second end engaging around a part circumferential portion of the pivot pin and maintaining said engagement as the handrail assembly pivots between the erect position and the compact position, the curved second end of the retaining clip sliding over the part circumferential portion of the pivot pin during such pivoting.

2. The ramp system of claim 1 wherein the fixed pivot pin is mounted to the outside of an upright kick plate portion of the floor assembly.

3. The ramp system of claim 1 wherein the bracket comprises a main plate and a pair of side plates integrally connected to respective opposed sides of the main plate, the first end of the bracket comprising a pair of openings in the respective bottom ends of the pair of side plates and through which pair of openings the fixed pivot pin is received.

4. The ramp system of claim 2 wherein the kick plate portion of the floor assembly has a cut-out region comprising a first side edge and a second side edge facing the first side edge, the fixed pivot pin having a first end mounted to the first side edge of the cut-out region and having a second end mounted to the second side edge of the cut-out region, the bracket passing pivotally through the cut-out region as the post of the handrail assembly pivots between the erect position and the compact position.

5. The ramp system of claim 4 wherein the bracket is located substantially on the outside of the kick plate portion when the post of the handrail assembly is in the erect position, and is located substantially on the inside of the kick plate portion when the post of the handrail assembly is in the compact position.

* * * * *